United States Patent [19]

Robinson

[11] 4,254,393

[45] Mar. 3, 1981

[54] TREATMENT OF FUEL

[76] Inventor: T. Garrett Robinson, P.O. Box 128, Galena, Md. 21635

[21] Appl. No.: 59,576

[22] Filed: Jul. 23, 1979

[51] Int. Cl.[3] ..... H01F 7/00

[52] U.S. Cl. ..... 335/209; 335/305

[58] Field of Search ..... 335/209, 305

[56] References Cited

U.S. PATENT DOCUMENTS

| | | | |
|---|---|---|---|
| 3,349,354 | 10/1967 | Miyata | 335/209 |
| 3,462,720 | 8/1969 | Miyata | 335/305 |

*Primary Examiner*—Harold Broome

*Attorney, Agent, or Firm*—Connolly and Hutz

[57] ABSTRACT

Fuel, such as flows from a fuel pump to a carburetor, is treated by subjecting the fuel to the influence of magnetic fields and thereafter an electric field; the magnetic fields are applied by a series of sets of spaced magnets aligned with each other.

8 Claims, 5 Drawing Figures

TREATMENT OF FUEL

BACKGROUND OF INVENTION

The present invention is directed to devices for improving the efficiency of fuel and has particular application for improving the efficiency of fuel used in vehicles. Various arrangements exist which deal with this problem. For example, U.S. Pat. No. 3,349,354 discloses a magnetic device which treats hydrocarbon fuel by flowing the fuel through the hollow center of a magnet assembly and thence into a chamber having means for applying an electromagnetic force so that the fuel is subjected to the combined effects of a very strong magnetic flux and to the influence of an electric field.

SUMMARY OF INVENTION

An object of this invention is to provide a device of the above type which is particularly effective in treating fuel.

A further object of this invention is to provide such a device which subjects the fuel to the magnetic flux of a plurality of sets of spaced magnets with the particular arrangement thereof being selected in accordance with the type of gas and type of vehicle.

THE DRAWINGS

Figure 2:
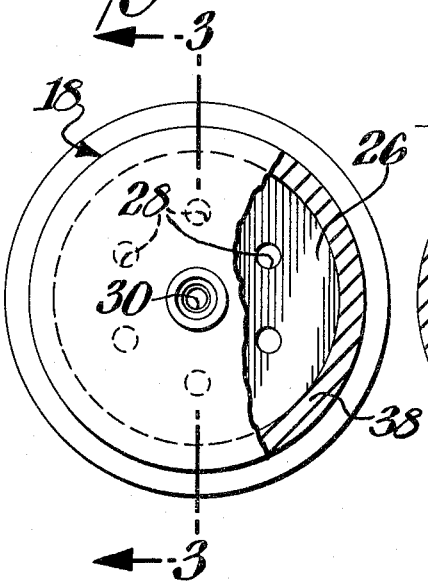
FIG. 2 is an end view partly in section of the fuel treating assembly shown in FIG. 1.
Figure 4:
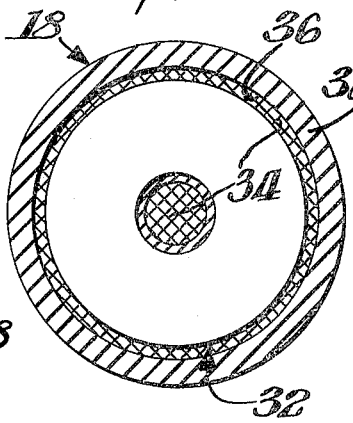
Figure 5:
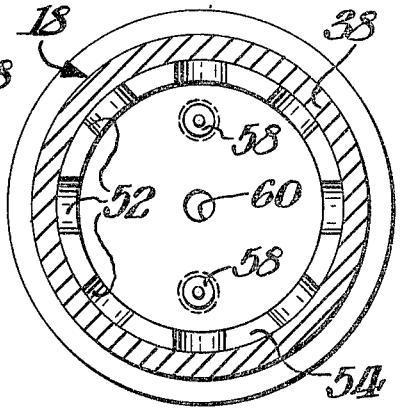
Figure 3:
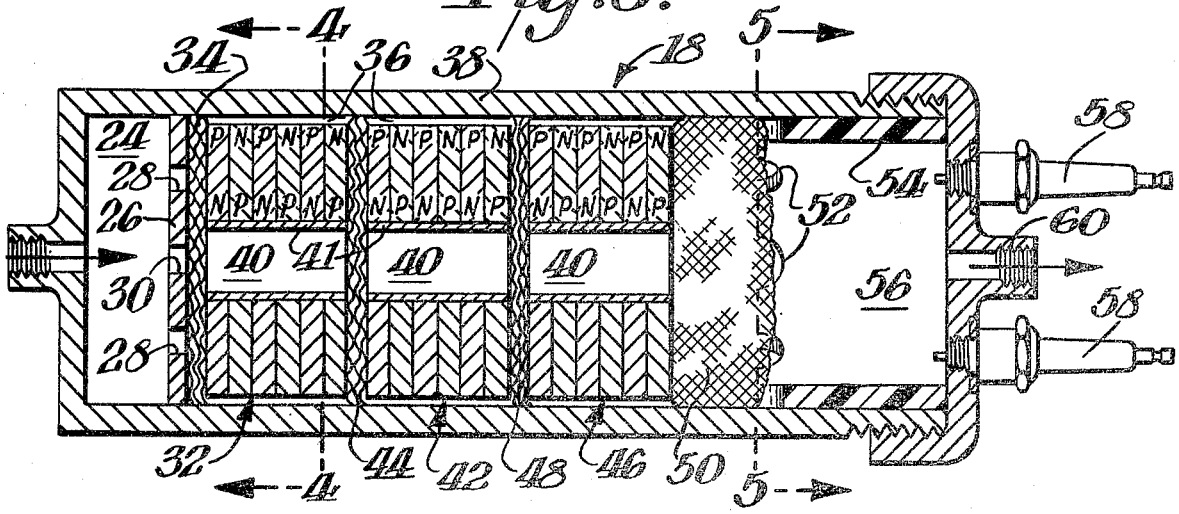

FIG. 3 is a cross-sectional view taken through FIG. 2 along the line 3—3; and FIGS. 4–5 are cross-sectional views taken through FIG. 3 along the lines 4—4 and 5—5.

DETAILED DESCRIPTION

Figure 1:
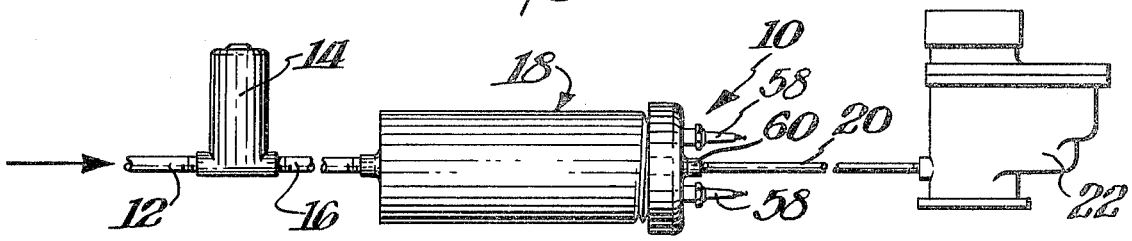
FIG. 1 is a schematic view showing an arrangement in accordance with this invention.

FIG. 1 schematically shows device 10 which includes inlet line 12 drawing the fuel into fuel pump 14 and the line 16 to the entrance of treating assembly 18. The treated fuel exits through line 20 and flows into carburetor 22.

FIG. 3 is a cross-sectional view of treating device 18 and along with FIGS. 2 and 4–5, show the details thereof. The upstream end of device 18 includes an inlet chamber 24 closed off by a distributor plate 26. As shown in FIGS. 2–3, distributor plate 26 includes a series of coarcuate holes 28 and a central hole 30. Plate 26 may be made of any suitable material such as metal. A first set of magnets 32 is provided downstream from distributor plate 26 and spaced therefrom by screen or filter material 34 which is compressed between magnets 32 and plate 26 and thereby in contact therewith. As shown in FIG. 3, an annular space 36 is between the outer periphery of magnets 32 and the inner surface of casing 38. Additionally, magnets 32 are ring magnets with an axial passage 40 in line with central opening 30 of distributor plate 26. A second set of magnets 42 is provided spaced from first set of magnets 32 again with screen material 44 therebetween and in contact with both sets of magnets. Similarly, a third set of magnets 46 is provided downstream from magnets 42 and spaced therefrom by screening 48 which is in contact with both sets of magnets 42 and 46. Finally, additional screen material 50 is provided downstream from the various sets of spaced magnets at the end of the magnetic chamber formed in casing 38. Screen material 50 is preferably in the form of a thick bundle of screen having undulations of cutouts 52 to permit the screen material 50 to be pressed against magnet assembly 46 and thus also permitting compression of screen material 50.

After assembly of the distributor plate and the various sets of magnets and screen material in casing 38, a sleeve 54 is inserted downstream therefrom in electrode chamber 56 to retain the various components in a relatively stable axial position in the magnetic treating chamber without separate mounting means. The provision of the screen material which presses against the various magnet assemblies permits the magnet assemblies to be relatively tightly held in axial position while still spaced from each other.

The fuel entering inlet chamber 24 flows through distributor plate 26 and more particularly through its openings 28, 30 so that some fuel flows in the annular space 36 and the remaining fuel flows through the aligned axial openings 40 before exiting into electrode chamber 56. While thus flowing, the fuel is subjected to the magnetic force applied to the individual magnets. After being so subjected to the magnetic flux, the fuel is subjected to an electrical force applied by, for example, a pair of spark plugs 58. The fuel then discharges through outlet 60 connected to line 20 (FIG. 1).

Fuel treating device 18 may take various forms and be of various sizes in accordance with the desired end results. For example, casing 38 may have a 3 inch inside diameter. The ring magnets may have, for example, an outside diameter of about $2\frac{3}{4}$ inches. Where used for automobiles, the length of casing 38 may be, for example, 6 inches or 9 inches and may be 12 inches for diesel trucks. Where a 6 inch length is used for automobiles, the fuel may be pumped therein at a rate of 5 gallons per hour. The sets of magnets may include 3 sets as illustrated with 4 magnets in each set (for unleaded gas) or only 2 sets of magnets with 6 individual magnets in each set (for leaded gas). The magnets in all embodiments are arranged with a polarity of one magnet opposed to its adjacent magnet as illustrated. Where a 9 inch length is used then, for example, 9 gallons per hour would be fed and the magnet assemblies could include 3 sets of magnets with each set having 6 magnets or 3 sets of magnets with the first and third sets having 6 individual magnets and the central set having 4 magnets. Where only 2 sets of magnets are used, such as for leaded gas, each set has 9 magnets. For diesel fuel with casing 38 being 12 inches long, 26 gallons per hour fuel would be fed and the magnet assembly could include 3 sets of magnets with each set having 8 magnets or 3 sets of magnets with 8 magnets in each end set and 6 magnets in the central set or 2 sets of magnets with 12 magnets in each set.

Advantageously, each magnet is mounted on a hollow sleeve 41 so that its aligned central openings form the axial passageway 40. The clearance between the outer periphery of the magnets and the inner surface of casing 38 would be, for example, $\frac{1}{4}$ inch so that the annular space 36 would be half of that clearance or $\frac{1}{8}$ inch. Insert or retainer 54 is advantageously made of a suitable material such as PVC and is 2 inches in length.

It is to be understood that the various dimensions and materials previously referred to are merely exemplary and are given so that one may practice the invention.

What is claimed is:

1. A device for treating fuel comprising a fuel treating casing having a magnetic flux applying chamber and an electrical field applying chamber downstream therefrom, a plurality of sets of spaced magnets in said magnetic flux applying chamber, a distributor plate having a plurality of openings therethrough at the upstream end of said magnetic flux applying chamber, a screen material between said distributor plate and the upstream set of magnets and between each pair of sets of magnets and the downstream end of said magnetic flux applying chamber, a plurality of spacers in contact with said sets of magnets maintaining said sets of magnets spaced from each other and from said distributor plate while providing a relatively tightly held axially positioned assembly, said spacers also providing open areas between adjacent sets of magnets, said screen material comprising at least some of said spacers in contact with its respective sets of magnets, said set of magnets having a cross section conforming to and spaced from the inner wall of said casing to provide a peripheral passageway between said inner wall and said sets of magnets, said sets of magnets cross section also conforming to the shape of said distributor plate, an axial passageway formed through said sets of magnets, said distributor plate having a central hole and a plurality of coarcuate holes for directing the fuel passing therethrough into said axial passageway and into said peripheral passageway to facilitate the fuel being subjected to the magnetic force applied by the individual magnets of said sets, electrical field producing means in said electrical field applying chamber, an inlet opening in the upstream end of said casing and an outlet opening in the downstream end of said casing whereby fuel may be fed into said casing and pass through said distributor plate and thence be subjected to the influence of said spaced sets of magnets and then to the electrical force before being discharged therefrom.

2. The device of claim 1 wherein said sets of magnets comprise ring magnets having a polarity whereby adjacent magnets are of opposite polarity to each other.

3. The device of claim 2 wherein said electrical field producing means comprises a pair of spark plugs.

4. The device of claim 3 wherein said sets of magnets and said screen material are held in place in contact with each other by a retaining insert located in said electrical field applying chamber.

5. The device of claim 4 wherein said spaced sets of magnets include the same number of magnets in the downstream most and upstream most sets thereof.

6. The device of claim 5 wherein said spaced sets of magnets comprise two spaced sets of magnets.

7. The device of claim 5 wherein said spaced sets of magnets comprise three sets of magnets.

8. The device of claim 7 wherein the central set is of lesser number of magnets than the upstream most and downstream most sets.

* * * * *